US006340985B1

(12) United States Patent
Imai

(10) Patent No.: US 6,340,985 B1
(45) Date of Patent: Jan. 22, 2002

(54) THERMAL RECORDING APPARATUS

(75) Inventor: Shinji Imai, Kanagawa (JP)

(73) Assignee: Fuji Photo Film Co. Ltd., Kanagawa (JP)

( * ) Notice: Subject to any disclaimer, the term of this patent is extended or adjusted under 35 U.S.C. 154(b) by 0 days.

(21) Appl. No.: 09/207,611

(22) Filed: Dec. 9, 1998

(30) Foreign Application Priority Data

Dec. 10, 1997 (JP) ..... 9-339766

(51) Int. Cl.[7] ..... B41J 2/315
(52) U.S. Cl. ..... 347/212; 347/187
(58) Field of Search ..... 347/187, 224, 347/212, 133, 211, 256, 225, 185; 156/230; 235/382

(56) References Cited

U.S. PATENT DOCUMENTS

| | | | | |
|---|---|---|---|---|
| 3,080,254 A | | 3/1963 | Grant | 117/36.8 |
| 3,847,612 A | | 11/1974 | Winslow | 96/67 |
| 4,123,282 A | | 10/1978 | Winslow | 96/114.1 |
| 5,300,169 A | * | 4/1994 | Tahara | 156/230 |
| 5,430,277 A | * | 7/1995 | Ohno et al. | 235/382 |
| 5,552,818 A | * | 9/1996 | Agano et al. | 347/133 |
| 5,771,054 A | * | 6/1998 | Dudek et al. | 347/102 |
| 5,909,232 A | | 1/1999 | Goto et al. | 347/187 |
| 6,034,707 A | * | 3/2000 | Agano | 347/211 |

FOREIGN PATENT DOCUMENTS

| | | | |
|---|---|---|---|
| EP | 0 704 318 | 4/1996 | B41M/5/32 |
| JP | 6-198924 | 7/1994 | B41J/2/32 |
| JP | 6-198925 | 9/1994 | B41J/2/32 |
| JP | 7-164651 | 6/1995 | B41J/2/32 |
| JP | 8-179459 | 7/1996 | G03C/1/498 |
| JP | 9-20021 | 1/1997 | B41J/2/32 |

* cited by examiner

*Primary Examiner*—N. Le
*Assistant Examiner*—K. Feggins
(74) *Attorney, Agent, or Firm*—Sughrue Mion, PLLC

(57) ABSTRACT

There is provided a thermal recording apparatus which includes a pre-heating section for heating a thermal recording material to a temperature 6 to 20° C. lower than a color forming temperature; a heat recording section for recording an image by heating the pre-heated thermal recording material imagewise; and a post-heating section for heating the thermal recording material to a temperature lower than the color forming temperature. The thermal recording apparatus uses the thermal recording material having a thermal image forming layer that includes a heat-reducing metallic compound, and optionally at least one of a reducing agent of the heat-reducing metallic compound, a dye for infrared absorption and a toner. This apparatus is capable of performing highly sensitive image recording using a thermal recording material having an image forming layer in which an image is formed with a heat-reducing metallic compound. Furthermore, black tone images can be formed.

26 Claims, 3 Drawing Sheets

THERMAL RECORDING APPARATUS

BACKGROUND OF THE INVENTION

This invention relates to the technical field of thermal recording apparatuses that perform image recording with thermal recording materials containing a heat-reducing metallic compound such as silver behenate or the like.

Images taken for medical diagnosis by ultrasonography, computerized tomography (CT), magnetic resonance imaging (MRI) or radiography are conventionally recorded on silver salt photosensitive materials and used in various diagnoses as hard copies.

The silver salt photosensitive materials have the advantage of yielding high-quality images, but the development thereof is time-consuming and laborious because of the necessity of wet processing including color development, fixing-bleaching and rinsing. Maintenance of developing machines such as wet-type processors is also a time-consuming job. Therefore, it is desired that hard copies be outputted by an image forming method which eliminates the need for wet processing.

Thermal image recording is known as an image forming method that does not require wet processing. This recording system uses thermal recording materials that produce color by heating. The materials are heated imagewise in accordance with images to be recorded, thereby producing hard copies each having a visible image formed thereon. Image recording is usually performed by imagewise heating of the thermal recording materials with a light beam such as laser beam or a thermal head.

Thus, in thermal image recording in which a light beam is used to heat a thermal recording material and to form color thereon, the light beam emitted from a heat mode laser is modulated in accordance with an image to be recorded and deflected in a main scanning direction. The thermal recording material is heated imagewise by two-dimensional scanning with the light beam, while being held in a specified image recording position and being transported in the auxiliary scanning direction perpendicular to the main scanning direction, whereupon the image is recorded thereon.

On the other hand, thermal image recording uses a thermal head having a glaze in which heat-generating elements are arranged in one direction (i.e., main scanning direction). The respective heat-generating elements are heated in accordance with an image to be recorded, while moving the glaze and a thermal recording material relative to each other in the direction perpendicular to the main scanning direction, with the former pressed on the latter. The thermal recording material is thus heated imagewise.

In recent years, the quality of the image obtained by thermal recording has been significantly improved, and an extension of its use from the conventional ultrasonic imaging to other applications such as CT, MRI and radiography that require large and high-quality images is being reviewed.

Especially, thermal image recording with the heat mode laser can provide images of which the resolving power is as high as in image recording by light beam scan exposure on silver salt photosensitive materials.

A thermal recording material having an image forming layer that comprises a heat-reducing metallic compound such as an organic silver salt, a reducing agent thereof, a dye for infrared absorption and a toner, is known as one of the thermal recording materials utilized in such thermal image recording.

In this thermal recording material, metal in the heat-reducing metallic compound is reduced by heating to form an image and a latent image, which are then subjected to another heat treatment, whereupon a final image is obtained (see Unexamined Published Japanese Patent Application (Kokai) No. 179459/1996).

This type of thermal recording material is however low in sensitivity, which makes it difficult to obtain images having a sufficiently high quality, in applications which require high-quality images having high tone resolving power and resolution as in the aforementioned images for medical use.

In addition, the color tone of the image formed on the thermal recording material is brown, and the application thereof to the fields such as medical field in which black tone images are preferred because of their easy distinction of shadows, is disadvantageous.

SUMMARY OF THE INVENTION

The present invention has been accomplished under these circumstances and has an object of providing a thermal recording apparatus capable of performing a highly sensitive image recording using a thermal recording material having an image forming layer in which an image is formed with a heat-reducing metallic compound such as an organic silver salt, whereupon the resulting image has a black tone.

In order to achieve the above object, the present invention provides a thermal recording apparatus comprising:

pre-heating means for heating a thermal recording material on which an image is to be recorded, to a temperature 6 to 20° C. lower than a color forming temperature;

heat recording means for recording the image by heating the pre-heated thermal recording material imagewise; and post-heating means for heating the thermal recording material on which the image was recorded, to a temperature lower than the color forming temperature, wherein said thermal recording apparatus uses the thermal recording material having a thermal image forming layer that comprises a heat-reducing metallic compound, and optionally at least one component selected from the group consisting of a reducing agent of said heat-reducing metallic compound, a dye for infrared absorption and a toner.

Preferably, the thermal recording means comprises one dimensional thermal recording means for recording thermally and one-dimensionally the image on the thermal recording material in a first direction and moving means for moving the thermal recording material relative to the one dimensional thermal recording means in a second direction perpendicular to the first direction, and thereby performing thermal image recording two-dimensionally on the thermal recording material.

Preferably, at least one of the pre-heating means and the post-heating means heats the thermal recording material in the first direction.

Preferably, at least one of the pre-heating means and the post-heating means comprises a heating light source extending in the first direction.

Preferably, the moving means is a scan transport means for transporting the thermal recording material in the second direction.

Preferably, the scan transport means comprises two transport roller pairs for transporting the thermal recording material in the second direction, and at least one roller of the two transport roller pairs has a heating source built in and functions as at least one of the pre-heating means and the post-heating means.

Preferably, the scan transport means comprises a platen roller for transporting the thermal recording material in the second direction and two transport rollers for nipping and transporting the thermal material between themselves and the platen roller, and at least one roller of the platen roller and the two transport rollers has a heating source built in and functions as at least one of the pre-heating means and the post-heating means.

Preferably, the one dimensional thermal recording means is a light beam scan optical system for deflecting and scanning a light beam in the first direction.

Preferably, the light beam scan optical system comprises modulation means for modulating the light beam in accordance with the image to be recorded using pulse width modulation, pulse number modulation or pulse amplitude modulation.

Preferably, the modulation means is a light source drive control means for modulating the light beam in accordance with the image to be recorded.

Preferably, the modulation means is an exterior modulator for modulating the light beam in accordance with the image to be recorded.

Preferably, the one dimensional thermal recording means is a thermal head having a plurality of heat generating elements for heating the heat-generating elements in accordance with the image to be recorded and extending in the first direction.

Preferably, imagewise heating of the heat-generating elements of the thermal head is controlled by pulse width modulation, pulse number modulation or pulse amplitude modulation in accordance with the image to be recorded.

Preferably, at least one of the pre-heating means and the post-heating means uniformly heats an entire surface of the thermal recording material.

Preferably, pre-heating by the pre-heating means is performed simultaneously with thermal image recording by the heat recording means.

Preferably, pre-heating by the pre-heating means is performed prior to thermal image recording by the heat recording means.

The pre-heating means heats the thermal recording material to a temperature preferably 10 to 18° C., more preferably 14 to 16° C. lower than a color forming temperature.

The post-heating means heats the thermal recording material to a temperature preferably 10 to 30° C., more preferably 15 to 20° C. lower than a color forming temperature.

DETAILED DESCRIPTION OF THE INVENTION

The thermal recording apparatus of the invention will now be described in detail with reference to the preferred embodiments shown in the accompanying drawings.

Figure 1:
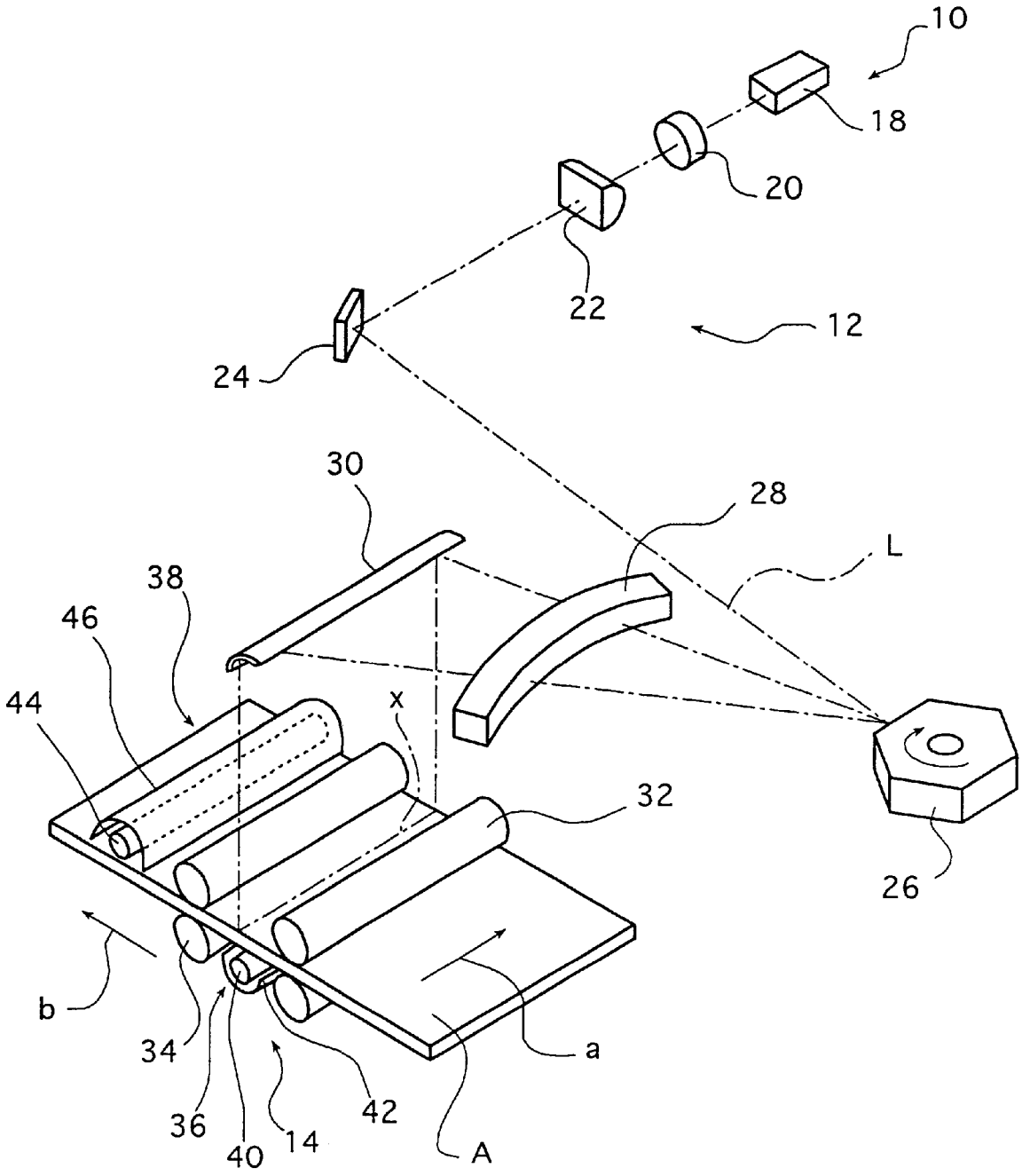
FIG. 1 is a schematic perspective view of an embodiment of the thermal recording apparatus of the invention.

FIG. 1 shows a schematic perspective view of an embodiment of the thermal recording apparatus of the invention.

The thermal recording apparatus 10 shown in FIG. 1 performs imagewise exposure of a thermal recording material A to a light beam L for thermal recording emitted from a heat mode laser. The thermal recording material A is thus imagewise heated and an image is recorded thereon. The thermal recording apparatus 10 basically comprises a light beam scan optical system 12 for making the light beam L incident on the thermal recording material A; scan transport means 14 for transporting the thermal recording material A being held in a recording position x in an auxiliary scanning direction; pre-heating means 36 for heating the thermal recording material A on which an image is to be recorded; and post-heating means 38 for heating the thermal recording material A on which the image was recorded.

In the thermal recording apparatus of the invention, a material having a thermal image forming layer which comprises a heat-reducing metallic compound, and optionally at least one of a reducing agent thereof, a dye for infrared absorption and a toner, is used as the thermal recording material A (hereinafter referred to as "thermal material A").

The heat-reducing metallic compound in the thermal material A refers to a metallic compound which can form a catalytic latent image by heating the material A in the presence of a reducing agent at a high temperature ranging from 100 to 1200° C. for a very short time period of between 0.01 μsec to 100 msec. Exemplary heat-reducing metallic compounds include organic and inorganic metal salts of gold, silver, copper, rhodium, palladium and other elements. Organic silver salts and inorganic silver salts such as silver halide are preferred, and silver salts of aromatic carboxylic acids and aliphatic carboxylic acids having 9 to 30 carbon atoms are especially preferred.

Specific examples of the preferred silver salts of aliphatic carboxylic acids include silver behenate, silver stearate, silver oleate, silver laurate and the like, and examples of the preferred silver salts of aromatic carboxylic acids include silver benzoate and those of benzoic acid derivatives, such as silver 3,5-dihydroxybenzoate, silver methylbenzoate, silver telephthalate, silver salicylate and the like.

One or more organic silver salts are preferably used in the image forming layer in an amount of 5 to 90% by weight.

The image forming layer of the thermal material A comprises preferably at least one, more preferably all of the reducing agent of the heat-reducing metallic compound, the dye for infrared absorption and the toner.

A variety of compounds which can reduce a metal ion such as silver ion contained in the heat-reducing metallic compound to a metal can be used as the reducing agent (or developer). Conventional photographic developers such as phenidone, hydroquinones and catechols, especially a hindered phenol reducing agent are preferably used. Preferably, a plurality of agents may be combined so that the content thereof in the image forming layer is about 1 to 10% by weight.

The dye for infrared absorption is used to obtain an excellent sensitivity by light-to-heat conversion when recording with the heat mode laser. Compounds absorbing near infrared rays ranging preferably from 600 nm to 1500 nm, especially from 700 nm to 1100 nm are preferably used.

Suitable examples of the dye for infrared absorption include organic dyes such as merocyanines, cyanines, tricarbocyanines, selenotricarbocyanines and enaminetricarbocyanines.

More than one dye for infrared absorption may be combined as required.

The toner is effective for wetting of the silver salts as described above, and control of the pigment forming speeds, pigment dispersion and image hue, and the like. One or more toners are preferably contained in an amount of 0.1 to 10% by weight of the silver salts.

Preferred examples of the toner include those as disclosed in each specification of U.S. Pat. Nos. 3,080,254, 3,847,612 and 4,123,282. Specifically, cyclic imides such as phthalimide, hydroxyphthalimide and succinimide; naphthalimides such as N-hydroxy-1,8-naphthalimide; cobalt complex such as cobalt hexaminetrifluoroacetate; and mercaptans such as 3-mercapto-1,2,4-triazole.

The image forming layer having the components as described above can be formed by a known method in which a coating (emulsion) having necessary components dissolved or dispersed in a known (natural or synthetic) resin such as polyvinyl acetal, polyvinyl acetate or cellulose acetate is prepared and applied to the substrate by dip coating, air-knife coating or other methods and dried. Alternatively, the above components may be separately incorporated in a plurality of layers.

A variety of substrates used in known thermal recording materials including polyester film, polyethylene terephthalate film, cellulose nitrate film and the like are available as the substrate of the thermal material A.

Various components other than the above components, for example a coating aid or other agents may be incorporated in the image forming layer of the thermal material A used in the invention. Alternatively, the thermal material A may have a plurality of layers including a protective layer, in addition to the image forming layer and the layers containing the above components.

Such thermal material A is described in detail in Japanese Patent No. 8-179459A (EP Patent No. 0704 318 A1).

The recording apparatus 10 records an image on the thermal material A by thermal recording means that comprises the light beam scan optical system 12 and the scan transport means 14.

The light beam scan optical system 12 is a known type that comprises a light source of the light beam L, a light deflector and an fθ (scanning) lens in combination and is used to emit the light beam L for imagewise exposure and heating of the thermal material A, thereby recording an image. The illustrated system comprises a light source 18 of the light beam L, a collimator lens 20, a cylindrical lens 22, a mirror 24, a polygonal mirror 26, an fθ lens 28 and a cylindrical mirror 30.

The light source 18 of the light beam L used to record an image on the thermal material A by imagewise heating, is driven by a driver (not shown) and emits the light beam L modulated in accordance with the image to be recorded. As the light source 18, can be used various sources that can emit the light beam L having a sufficient amount of heat to form color on the thermal material A, taking into consideration the progress of color forming by the action of the pre-heating means 36 and the post-heating means 38 to be described below. In the illustrated case, a semi-conductor laser (LD) is used in an example.

The method of modulating the light beam is not limited in any particular way, and pulse width modulation (PWM) or pulse number modulation (PNM) or light intensity modulation (pulse amplitude modulation: PAM) may be used. In the illustrated case, the LD is used as the light source 18 to control the drive of the light source 18, thereby directly performing thermal image recording by means of modulation. The present invention is not however limited thereto, and an exterior modulator such as an AOM (acoustic optical modulator) may be used.

The light beam L emitted from the light source 18 is transformed in the collimator lens 20 to parallel rays, which are incident on the cylindrical lens 22. This lens 22 composes tilt correcting optics of the polygonal mirror 26 together with the cylindrical mirror 30.

The light beam L that passed through the cylindrical lens 22 is reflected by the mirror 24 toward a specified direction and deflected by the polygonal mirror 26 used as the light deflector in the main scanning direction (shown by an arrow "a" in FIG. 1).

The light beam L deflected in the main scanning direction is adjusted in the fθ lens 28 such that a beam spot having a specified diameter can be formed in a predetermined recording position x, that is, on the scanning line. The cylindrical mirror 30 constituting the tilt correcting optics together with the above mentioned cylindrical lens 22 tilts down the light beam L that is then incident on the recording position x.

The scan transport means 14 constitutes the thermal recording means together with the light beam scan optical system 12, and is used to transport the thermal material A in the auxiliary scanning direction perpendicular to the main scanning direction (shown by an arrow "b" in FIG. 1), while the upper surface thereof being held in the recording position x. The illustrated scan transport means 14 comprises two transport roller pairs 32 and 34 that are located on opposite sides of the recording position (scanning line) x and that transport the thermal material A being held in the recording position x.

The light beam L modulated in accordance with the image to be recorded is deflected in the main scanning direction, as mentioned above. Therefore, the thermal material A is scanned two-dimensionally with the light beam L while being transported in the auxiliary scanning direction by means of the scan transport means 14. Then, the thermal material A is heated imagewise, thereby forming colors each having a density corresponding to an amount of heat, that is, a given heat energy.

The recording apparatus 10 is provided with the pre-heating means 36 in the recording position x, and with the post-heating means 38 downstream of the scan transport means 14 in the auxiliary scanning direction (hereinafter referred to as "downstream").

The illustrated pre-heating means 36 is located in the recording position x under the thermal material A which is transported by means of the two transport roller pairs 32 and 34. The pre-heating means 36 comprises a bar-shaped halogen lamp 40 and a reflector 42. The former extends in the main scanning direction as a heating light source, and the latter extends in the same main scanning direction to reflect the heating light from the halogen lamp 40 on the thermal material A. The post-heating means 38 is located over the thermal material A downstream of the scan transport means 14, and comprises a halogen lamp 44 and a reflector 46 similar to those of the pre-heating means 36.

In the recording apparatus 10 of the invention, the thermal material A is first pre-heated by the pre-heating means 36 at a temperature 6 to 20° C. lower than the color forming temperature before an image is recorded thereon in the recording position x. Thereafter, the thermal material A having the image formed thereon is post-heated by the post-heating means 38 at a temperature lower than the color forming temperature, while being transported in the auxiliary scanning direction. The image on the thermal material A is thus completed and ejected as a hard copy having the formed image into an ejection tray (not shown).

It is well known to perform image recording by pre-heating thermal materials at a temperature lower than the color forming temperature in order to improve the sensitivity of thermal image recording. As a matter of course, high pre-heating temperatures are preferably used to achieve highly sensitive recording in typical thermal recording. Therefore, pre-heating is usually performed at a temperature much closer to the color forming temperature of the thermal material used.

However, it was found by the inventor's investigations that image recording can be performed in a more sensitive manner by the method in which the thermal material A as described above is pre-heated at a temperature to a certain extent lower than the color forming temperature, not at a temperature much closer to the color forming temperature and post-heated after recording is done. In addition, the tone of the image to be formed can be further darkened by pre-heating at a temperature to a certain extent lower than the color forming temperature.

Figure 2A:
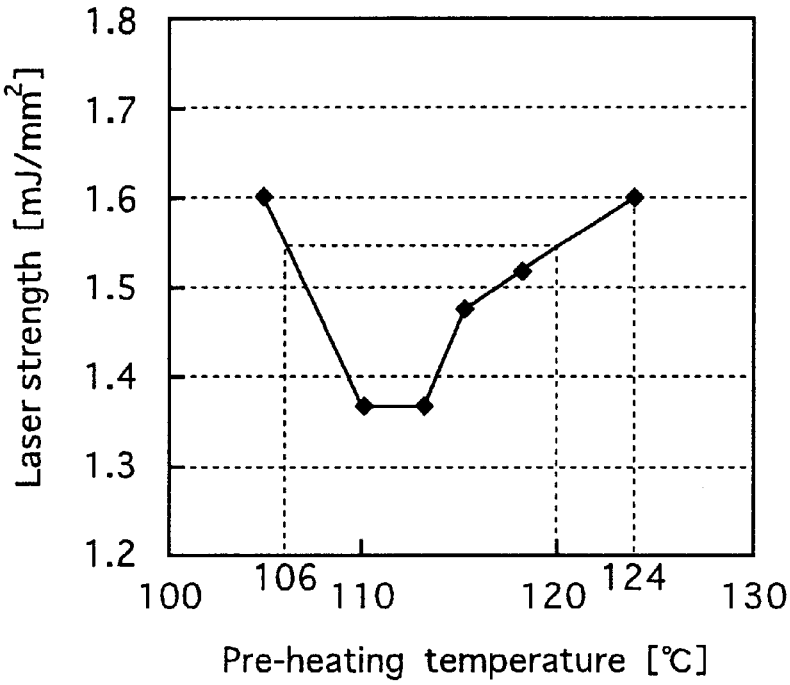
FIGS. 2*a* and 2*b* show the relationship between pre-heating temperature and laser strength and the relationship between laser strength and color forming density, respectively.
Figure 2B:
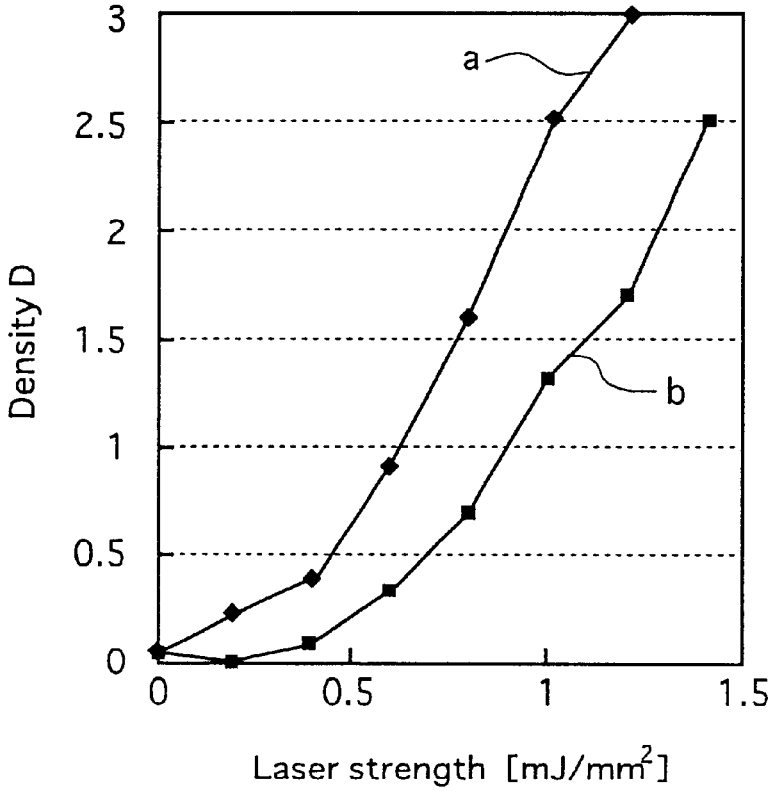

FIG. 2(*a*) shows the relationship between the pre-heating temperature of the thermal material A and the laser strength (or laser energy) required for color formation at a density D of 2. The thermal material A forms color at 126° C. As FIG. 2(*a*) shows, the laser strength required for color formation at the density D of 2 is lower at a pre-heating temperature range a little inferior to 124° C. than at the temperature much closer to the color forming temperature or 124° C. That is, the former provides more excellent sensitivity.

FIG. 2(*b*) shows the relationship between the laser strength and the color forming density when the same type of thermal material A was used. In FIG. 2(*b*), "a" shows an example in which pre-heating at 120° C. and thermal recording were performed, followed by post-heating at 106° C., and "b" shows another example in which pre-heating was performed at the temperature much closer to the color forming temperature or 124° C. before thermal recording was performed. In the graph, "a" shows higher color forming density values than "b".

In addition, the same type of thermal material A was used to perform pre-heating at 124° C. and thermal recording, followed by post-heating at 106° C. In this case, a clear fog occurred in the texture of the thermal material A.

As shown in FIG. 2(*a*), in the case of the material which forms color at 126° C., the laser strength required for color formation at the density D of 2 is the same at the pre-heating temperatures of 106° C. and 120° C. Therefore, it is clear from FIG. 2(*a*) that the laser strength required in the pre-heating temperature range of 106 to 120° C. is lower than that required at the pre-heating temperature of 120° C.

The results show that, when pre-heating is performed at a temperature ranging between 106° C. and 120° C., or 6 to 20° C. lower than the color forming temperature before thermal recording and subsequent post-heating at 106° C. are performed, color formation at densities equal to or higher than those of the curve "a" shown in FIG. 2(*b*) can be obtained.

That is, if the thermal material A is pre-heated at a temperature to a certain extent lower than the color forming temperature before the subsequent image recording and post-heating are performed, not only color formation by imagewise heating, but also the process of "the nucleation of silver latent image by pre-heating and imagewise heating that leads to the production of silver image by post-heating" progress more advantageously. Then, it is believed that the reaction progresses more efficiently which results in an increase in image density and tone darkening. Furthermore, thermal image recording can be performed without fog, although heating is used to achieve high sensitivity.

Therefore, according to the recording apparatus 10 of the invention having the aforementioned structure, highly sensitive image recording can be performed on the thermal material A, thereby obtaining a black image of higher quality.

The pre-heating temperature according to the invention is set to the range which is 6 to 20° C. lower than the color forming temperature of the thermal material A used. According to the investigations by the inventor, if the pre-heating temperature is outside the above temperature range, inconveniences including insufficient sensitivity and color browning may often occur. Within the above temperature range, black images can be recorded with sufficiently excellent sensitivity in a consistent manner, as shown in FIGS. 2(*a*) and 2(*b*). It should be noted that the pre-heating temperature is preferably 10 to 18° C., more preferably 14 to 16° C. lower than the color forming temperature.

The post-heating temperature is not limited to any particular value, as long as the temperature is lower than the color forming temperature of the thermal material A used. Post-heating is preferably performed at a temperature 10 to 30° C., especially 15 to 20° C. lower than the color forming temperature, in such aspects as recording sensitivity and image tone.

It should be noted that the entire surface of the thermal material A is preferably heated uniformly in both of pre-heating and post-heating in order to record a high-quality image without density unevenness.

The method of pre-heating and post-heating the thermal material in the thermal recording apparatus of the invention is not limited to the above method which uses a heating light source, but various known methods of heating sheets, preferably the entire surface thereof uniformly, can be used.

Thus, at least one roller of the transport roller pair 32 and/or the transport roller pair 34 constituting the scan transport means 14 may be replaced by a heat roller with a built-in heating source such as an electric heater, to perform pre-heating and/or post-heating.

Figure 3:
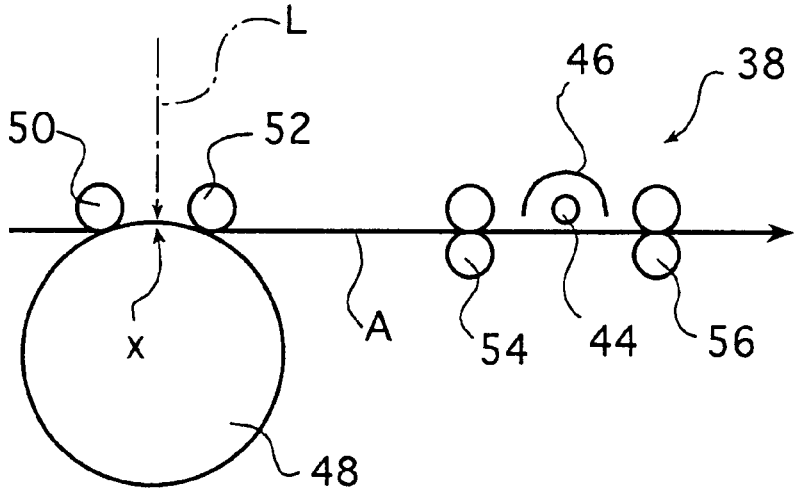
FIG. 3 is a schematic view of another embodiment of the thermal recording apparatus of the invention.

As shown in FIG. 3, the scan transport means 14 may comprise a platen roller 48 to transport the thermal material A being held in the recording position x, and a pair of rollers 50 and 52 to nip and transport the thermal material A in cooperation with the platen roller 48, with the two rollers 50 and 52 being in contact with the platen roller 48 on opposite sides of the recording position x (scanning line), and the platen roller 48 may be used as a heat roller with built-in heating means such as an electric heater or a light source. In this case, the thermal material A can be pre-heated at the same time as image recording with the light beam L. It should be noted that the reference signs 54 and 56 in FIG. 3 refers to transport roller pairs to hold and transport the thermal material A during post-heating in the post-heating section 38. Alternatively, heating by the platen roller 48 may be used in post-heating.

In pre-heating and post-heating, various other known heating means are available, as exemplified by a means using an electric heater or the like, a means depending on the adjustment of ambient temperature, a means using hot air, and a means using a heat block with a built-in electric heater coming into contact with the thermal material A.

Pre-heating is not limited to the illustrated case where thermal image recording and pre-heating are performed simultaneously, and may precede recording operation.

These pre-heating and post-heating means are described in detail in the commonly assigned Japanese Patent Nos. 6-198924A, 6-198925A, 7-164651A, 9-20021A and 9-20028A.

In the embodiments as mentioned above, thermal image recording is performed by imagewise heating of the thermal material A with the light beam L. However, the invention is not limited thereto and is advantageously applicable to thermal image recording with a thermal head.

Figure 4:
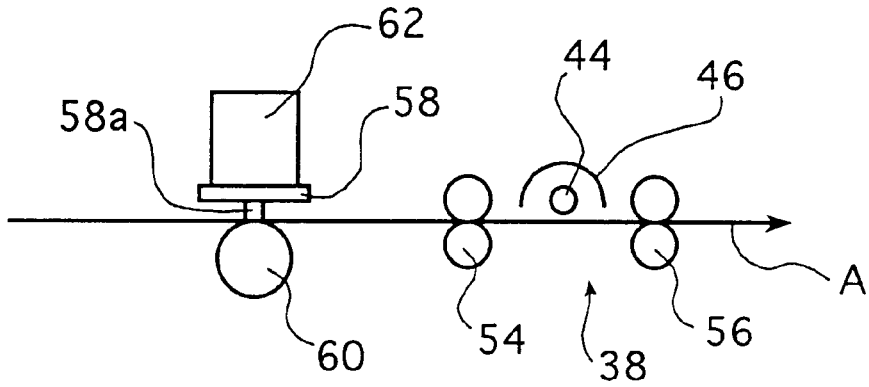
FIG. 4 is a schematic view of still another embodiment of the thermal recording apparatus of the invention.

FIG. 4 shows an exemplary case where the present invention is applied to thermal image recording using the thermal head.

As is well known, the thermal head 58 has a glaze 58*a* in which heat-generating elements are arranged in one direction (i.e., main scanning direction). The respective heat-generating elements are heated in accordance with an image to be recorded, while moving the glaze 58*a* and the thermal material A relative to each other in the direction perpendicular to the main scanning direction, with the former pressed on the latter. The thermal material A is thus thermally recorded by imagewise heating. In the illustrated case, thermal image recording is performed by means of the thermal head 58, while the thermal material A being transported by the platen roller 60. It should be noted that the thermal head 58 is cooled by a heat sink 62.

The platen roller 60 is a heat roller similar to the platen roller 48, and is provided downstream with the same post-heating section 38 as in FIG. 3. The thermal material A is pre-heated by the platen roller 60, and simultaneously thermal image recording is performed by the thermal head 58. After image recording, the post-heating section 38 performs post-heating with the light beam, whereupon an image is formed.

Where the present invention is applied to a thermal image recording apparatus using a thermal head, the pre-heating and post-heating methods are not limited to the illustrated cases where a heat roller and a heating light source are used, but all of the aforementioned heating means are available. In addition, pre-heating is also not limited to the case where thermal image recording and pre-heating are performed at the same time.

In addition, the modulating method in thermal image recording with the thermal head is not limited in any particular way, and pulse width modulation, pulse number modulation or light intensity (pulse amplitude) modulation may be used.

On the foregoing pages, the thermal recording apparatus of the invention has been described in detail but the invention is in no way limited to the stated embodiments and various improvements and modifications can of course be made without departing from the spirit and scope of the invention.

As described above in detail, according to the thermal recording apparatus of the invention, a thermal recording material having an image forming layer in which an image is formed with a heat-reducing metallic compound such as an organic silver salt, can be used to perform highly sensitive image recording. Furthermore, black tone images can be formed.

What is claimed is:

1. A thermal recording apparatus comprising:

pre-heating means for heating a thermal recording material on which an image is to be recorded, to a temperature 6 to 20° C. lower than a color forming temperature;

heat recording means for recording the image by heating the pre-heated thermal recording material imagewise; and post-heating means for heating the thermal recording material on which the image was recorded, to a temperature lower than the color forming temperature;

wherein the thermal recording apparatus uses the thermal recording material having a thermal image forming layer which comprises a heat-reducing metallic compound, and optionally at least one component selected from a group consisting of a reducing agent of the heat-reducing metallic compound, a dye for infrared absorption and a toner.

2. The thermal recording apparatus according to claim 1, wherein said thermal recording means comprises one dimensional thermal recording means for recording thermally and one-dimensionally the image on the thermal recording material in a first direction and moving means for moving the thermal recording material relative to said one dimensional thermal recording means in a second direction perpendicular to the first direction, and thereby performs thermal image recording two-dimensionally on the thermal recording material.

3. The thermal recording apparatus according to claim 2, wherein at least one of said pre-heating means and said post-heating means heats the thermal recording material in the first direction.

4. The thermal recording apparatus according to claim 2, wherein at least one of the pre-heating means and said post-heating means comprises a heating light source extending in the first direction.

5. The thermal recording apparatus according to claim 2, wherein said moving means is a scan transport means for transporting the thermal recording material in the second direction.

6. The thermal recording apparatus according to claim 5, wherein said scan transport means comprises two transport roller pairs for transporting the thermal recording material in the second direction, and wherein at least one roller of said two transport roller pairs has a heating source built in and functions as at least one of said pre-heating means and said post-heating means.

7. The thermal recording apparatus according to claim 5, wherein said scan transport means comprises a platen roller for transporting the thermal recording material in the second direction and two transport rollers for nipping and transporting the thermal material between themselves and said platen roller, and wherein at least one roller of said platen roller and said two transport rollers has a heating source built in and functions as at least one of said pre-heating means and said post-heating means.

8. The thermal recording apparatus according to claim 2, wherein said one dimensional thermal recording means is a light beam scan optical system for deflecting and scanning a light beam in the first direction.

9. The thermal recording apparatus according to claim 8, wherein the light beam scan optical system comprises modulation means for modulating the light beam in accordance with the image to be recorded using one of pulse width modulation, pulse number modulation and pulse amplitude modulation.

10. The thermal recording apparatus according to claim 9, wherein said modulation means is a light source drive control means for modulating the light beam in accordance with the image to be recorded.

11. The thermal recording apparatus according to claim 9, wherein said modulation means is a modulator for modulating the light beam in accordance with the image to be recorded.

12. The thermal recording apparatus according to claim 2, wherein said one dimensional thermal recording means is a thermal head having a plurality of heat generating elements for heating the heat-generating elements in accordance with the image to be recorded and extending in said first direction.

13. The thermal recording apparatus according to claim 12, wherein imagewise heating of said heat-generating elements of said thermal head is controlled by one of pulse width modulation, pulse number modulation and pulse amplitude modulation in accordance with the image to be recorded.

14. The thermal recording apparatus according to claim 1, wherein at least one of said pre-heating means and said post-heating means uniformly heats an entire surface of the thermal recording material.

15. The thermal recording apparatus according to claim 1, wherein pre-heating by said pre-heating means is performed simultaneously with thermal image recording by said heat recording means.

16. The thermal recording apparatus according to claim 1, wherein pre-heating by said pre-heating means is performed prior to thermal image recording by said heat recording means.

17. The thermal recording apparatus according to claim 1, wherein said pre-heating means heats the thermal recording material to a temperature 10 to 18° C. lower than a color forming temperature.

18. The thermal recording apparatus according to claim 1, wherein said pre-heating means heats the thermal recording material to a temperature 14 to 16° C. lower than a color forming temperature.

19. The thermal recording apparatus according to claim 1, wherein said post-heating means heats the thermal recording material to a temperature 10 to 30° C. lower than a color forming temperature.

20. The thermal recording apparatus according to claim 1, wherein the post-heating means heats the thermal recording material to a temperature 15 to 20° C. lower than a color forming temperature.

21. A thermal recording method, comprising the steps of:

pre-heating a thermal recording material on which an image is to be recorded, to a temperature 6 to 20° C. lower than a color forming temperature of said thermal recording material recording the image by heating the pre-heated thermal recording material imagewise; and post-heating the thermal recording material on which the image was recorded, to a temperature lower than the color forming temperature;

wherein said thermal recording material having a thermal image forming layer which comprises a heat-reducing metallic compound, and optionally at least one component selected from a group consisting of a reducing agent of the heat-reducing metallic compound, a dye for infrared absorption and a toner.

22. The thermal recording apparatus according to claim 21, wherein said pre-heating is performed prior to said recording.

23. The thermal recording apparatus according to claim 21, wherein said thermal recording material is pre-heated to a temperature 10 to 18° C. lower than a color forming temperature.

24. The thermal recording apparatus according to claim 21, wherein said thermal recording material is pre-heated to a temperature 14 to 16° C. lower than a color forming temperature.

25. The thermal recording apparatus according to claim 21, wherein said thermal recording material is post-heated to a temperature 10 to 30° C. lower than a color forming temperature.

26. The thermal recording apparatus according to claim 21, wherein said thermal recording material is post-heated to a temperature 15 to 20° C. lower than a color forming temperature.

* * * * *